US006443317B1

(12) United States Patent
Brozak, Jr.

(10) Patent No.: US 6,443,317 B1
(45) Date of Patent: Sep. 3, 2002

(54) CONVERSION TOWER DISPLAY SYSTEM

(75) Inventor: Emory N. Brozak, Jr., Strongsville, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 09/810,285

(22) Filed: Mar. 16, 2001

(51) Int. Cl.[7] ..... A47F 7/02
(52) U.S. Cl. ..... 211/85.1
(58) Field of Search ..... 211/85.1, 189, 211/196, 13.1, 85.2, 71.01, 72, 128.1, 133.1; 248/902

(56) References Cited

U.S. PATENT DOCUMENTS 4,614,272 A 9/1986 Shelton et al. ..... 211/163
5,052,563 A 10/1991 Camp ..... 211/13
5,054,624 A 10/1991 Camp ..... 211/13
5,853,090 A 12/1998 Brozak, Jr. ..... 211/13.1

*Primary Examiner*—Alvin Chin-Shue
*Assistant Examiner*—Sarah Purol
(74) *Attorney, Agent, or Firm*—Arter & Hadden LLP

(57) ABSTRACT

A flexible retail product display and storage system is adaptable to display and store a wide variety of products, so that the display remains fully stocked with seasonally appropriate merchandise to maximize the effectiveness of retail space. In a conversion tower embodiment, a receiving unit serves as a framework to support any suitable product display panel removably engageable with a frame, with the display panels having dissimilarly configured sides for supporting dissimilar types of products. This in combination with accessory panels on adjacent sides of the receiving unit which have interior volume and the ability to support complimentary products of still further dissimilar type, provides a flexible high density multi-product display and storage system. For display of eyewear products, a special spectacle support device which works in conjunction with anti-theft devices is also disclosed.

34 Claims, 5 Drawing Sheets

CONVERSION TOWER DISPLAY SYSTEM

FIELD OF THE INVENTION

The present invention pertains generally to a retail product display system unit for displaying consumer products in a retail environment and, more particularly, to a convertible display system that can assume multiple configurations for display of different types of products.

BACKGROUND OF THE INVENTION

Retail displays are critical to the sales of consumer products as they are the means by which products are positioned in the view and reach of prospective purchasers. Product displays are therefore configured to hold and position as much product as possible in the view of consumers in an orderly and appealing arrangement. To this end, a great variety of product display racks and product support devices have been contrived for all types of products. As the number of different types of displays multiplies, greater amounts of store space is occupied to the extent that not all displays can be on the sales floor at the same time. For seasonal items such as sunglasses, display racks are moved about a store throughout the year, according to demand and sales results. In many stores, seasonal display racks are placed in storage during the off-season. In large stores, this can lead to permanent misplacement of some display racks and the inventory carried thereon.

Furthermore, display units are often only partially stocked with the products they are configured to display. Store employees must obtain more product from a stockroom in order to restock a display unit. Due to this inconvenience, display units are often only partially stocked. In order to keep display units fully stocked, it would be preferable if display units were more convenient to restock.

Some attempts have been made to accommodate a variety of products on a single structure, such as described by U.S. Pat. Nos. 5,052,563 and 5,054,624, in the form of jewelry caddies having hanger arms and panels to support different types of jewelry. The structures, however, are not disclosed for use in retail point-of-sale applications and do not utilize multiple sided columns whereby one type of product is displayed or exposed while a different type of product is concealed. And U.S. Pat. No. 4,614,272 describes a device for displaying sunglasses in which sunglasses are arranged back-to-back in specifically constructed display columns not adaptable for simultaneous support of products dissimilar to sunglasses such as jewelry. U.S. Pat. No. 5,853,090 discloses a retail display with a plurality of the display columns, each column capable of displaying two different products. Because the device is configurable, it enables stores to select the type of product that will be displayed. However, to reconfigure the display disclosed in U.S. Pat. No. 5,853,090, one must rotate a column of the display. Enabling rotation of columns requires that there be more clearance between the columns. Because more clearance is required to allow a column to rotate, less product can be displayed at any given time.

Finally, recent developments in anti-theft devices have led to anti-theft tags designed for attachment to a nose bridge on a pair of eyeglasses. Because anti-theft devices must be difficult to remove in order to prevent theft, the attachment means of the anti-theft device to the eyeglasses is generally sturdy. Glasses equipped with anti-theft devices often create problems when displayed on retail display units because the display units are not designed to accommodate anti-theft tags. It would be preferable to have a eye glass display device that is equipped with a means of accommodating anti-theft devices attached to eyeglasses that are displayed.

SUMMARY OF THE PRESENT INVENTION

It is therefore an object of the present invention to provide a convertible display unit (alternatively referred to herein as a "convertible display system" or "conversion tower display system") that can be easily be reconfigured to change the products displayed, while maintaining a large display area. It is a further object of the present invention to provide a display with additional storage for products to be displayed. It is also an object of the present invention to provide a display device for displaying eyeglasses that is capable of accommodating anti-theft devices attached to eyeglasses that are displayed.

In one aspect of the present invention, there is provided a convertible retail product display unit. The display unit has at least one display panel which has a first and second side, the two sides being generally opposed. On one end of the display panel is at least one indexing member extending outward from the panel, and on another opposing end is a locking member extending outward from the panel. The display unit further comprises a receiving unit configured to accept the display panel. The receiving unit has on one end an indexing element for receiving the indexing member of the display panel, and on an opposite end a locking element for receiving the locking member of the display panel.

In another aspect of the present invention, a device for supporting eyewear on a retail display while accommodating an anti-theft tag is provided. The device comprises two generally parallel nose bridge supports, that are spaced apart such that the distance between said nose bridge supports is greater than a width of a generally rectangular strap of an anti-theft tag attached to the nose bridge of a pair of eyeglasses.

DETAILED DESCRIPTION OF PREFERRED AND ALTERNATE EMBODIMENTS

Figure 1:
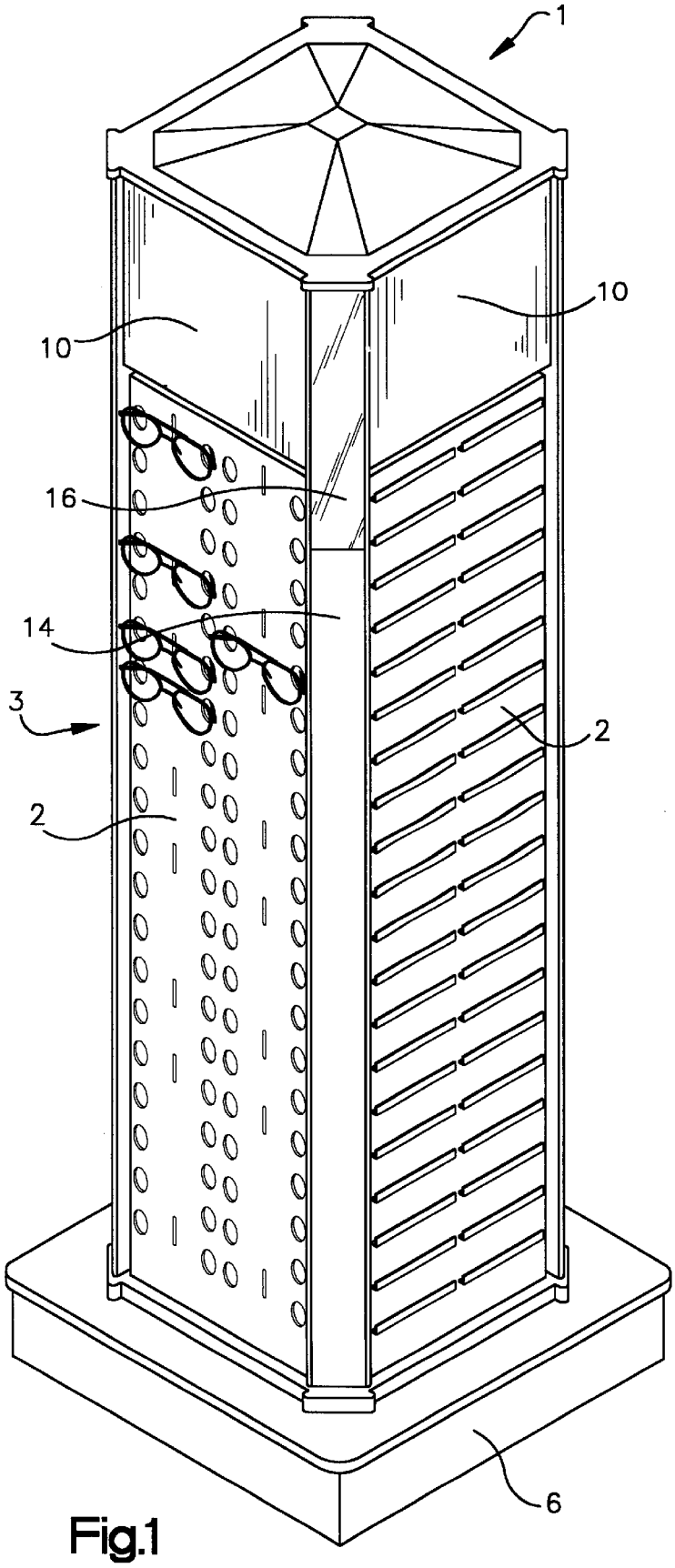
FIG. 1 is a perspective view of one embodiment of a convertible display unit of the present invention.

With reference to FIG. 1, an embodiment of a convertible retail product display unit, constructed in accordance with the invention, is indicated generally at 1. The display unit 1 may be a stand alone unit for displaying products, or it may be one unit of a product display system. FIG. 1 shows a four-sided display unit. The display unit 1 has at least one display panel 2 and a receiving unit 3 configured to accept display panel 2. In addition, the display unit 1 may also have a display panel 2 for displaying alternative products. It should be noted, however, that the display unit 1 of the present invention is not limited to any specific number of sides or panels. The display unit 1 may have as little as two sides with only one panel 2, and as many sides as are desired. Furthermore, the invention is not limited to having one panel 2 per side. The display unit 1 can also be configured so that there are multiple panels 2 on each side of the display unit 1. In the current embodiment, the display unit also comprises surfaces 14 of the receiving unit 3, located between display panels 2 which can hold mirrors 16 or other items such as additional product display or placards. In addition, surfaces 14 can display advertisements or additional information concerning the products displayed by the display unit 1. The display unit 1 may further contain a storage unit located between the display panels 2. In one presently preferred embodiment, the storage unit comprises a plurality of storage trays on a pole running through the center of the display unit, i.e., in the interior volume of the receiving unit. Furthermore, the storage trays are capable of rotation with respect to display unit 1 for easier access to the products stored by the storage trays.

Figure 2:
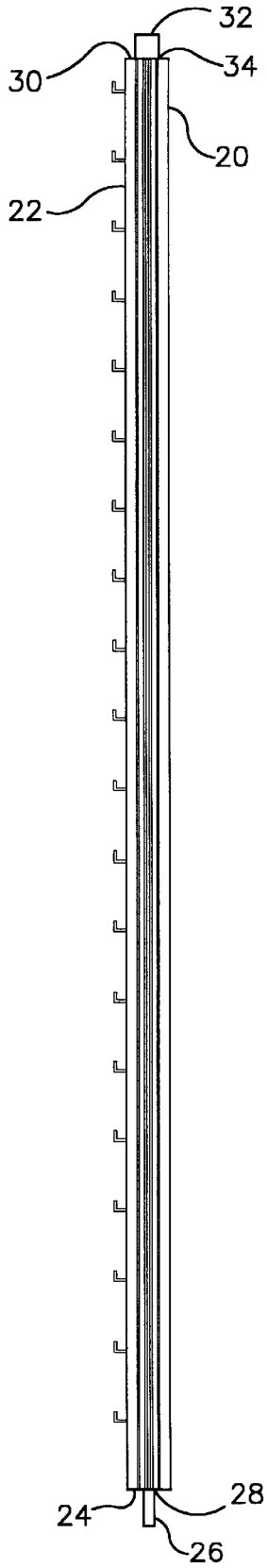
FIG. 2 is a side view of a display panel in isolation.

As shown in isolation in FIG. 2, an exemplary display panel 2 has a first display side 20 and a second display side 22. The first display side 20 and second display side 22 are generally opposed, and may be generally flat or generally curved, thereby creating a convex or concave display. The first and second display sides may be adapted to display different products, or they may be of the same design or adapted to display the same product or products. Extending outward from the display panel 2 is at least one indexing member 26. The indexing member 26, which may be in the form of a cylinder, tab, hemisphere or the like, or any other protrusion or engageable structure, extends outward from a first position 28 on the exterior of display panel 2. The indexing member 26 may be integrally formed to display panel 2, or attached through any means of attachment such as a bolt, rivet, nail, pin, or screw. The indexing member 26 functions to register or engage the display panel 2 within a display unit 1, and further functions to align display panel 2 within display unit 1.

Also extending outward from display panel 2 is a locking member 32. The locking member 32, which may also be in the form of a cylinder, tab, hemisphere or the like, or any other protrusion or engageable structure, extends outward from a second position 34 on the exterior of display panel 2. In this particular embodiment, second position 34 is generally opposed to the first position 28.

Figure 3:
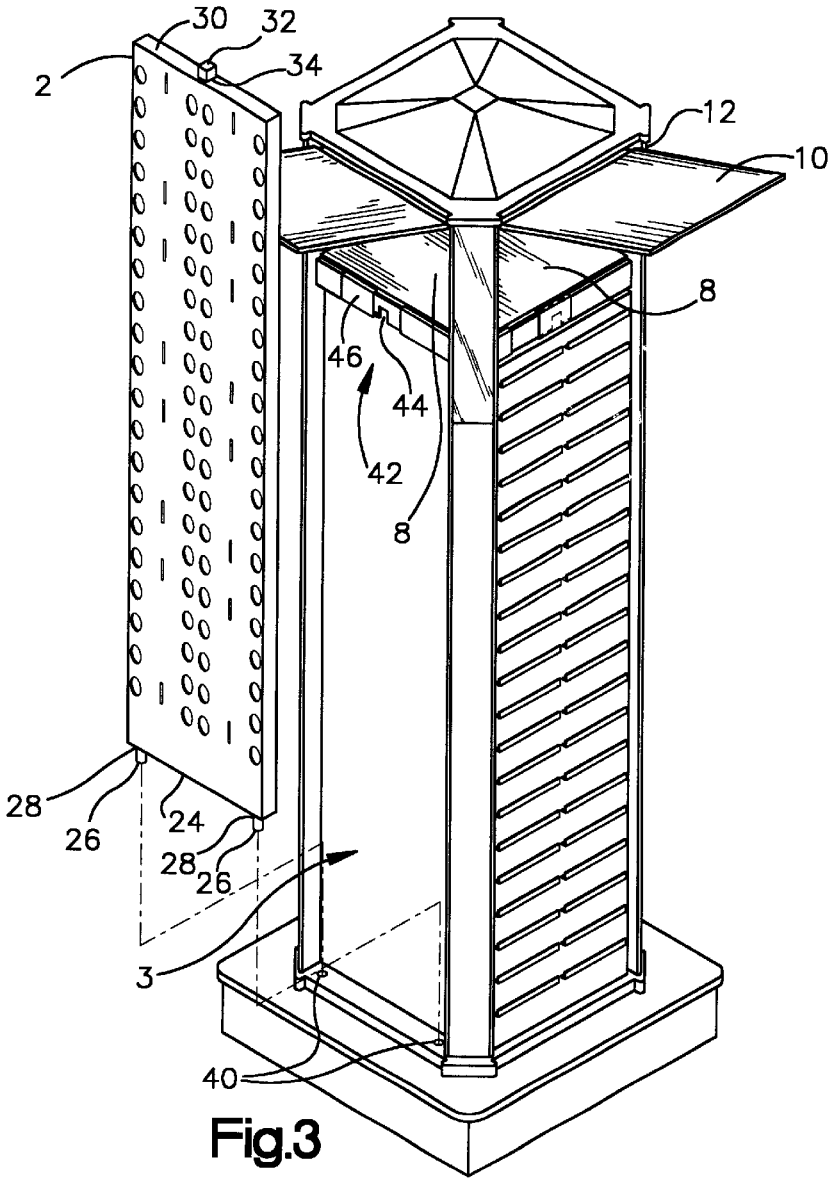
FIG. 3 is a perspective view of a receiving unit for receiving a display panel, and one arrangement of the display panel and receiving unit.

In one embodiment, display panel 2 also has a first engaging side 24 that is generally perpendicular to first display side 20 and second display side 22. Extending outward from the first engaging side 24 is at least one indexing member 26. In the presently preferred embodiment, there are two indexing members 26 spaced toward the edges of first engaging side 24, as shown in FIG. 3. Generally opposed to the first engaging side 24 is a second engaging side 30 that is also generally perpendicular to first display side 20 and second display side 22. Extending outward from the second engaging side 30 is a locking member 32. In the present embodiment, the locking member 30 is generally rectangular and located near the center of second engaging side 30. However, shape of the locking member 30 is not important: it could be spherical, cylindrical, oblong, etc. In one presently preferred embodiment, display panel 2 is generally rectangular in shape, and both engaging sides 24 and 28 are generally parallel and flat. It is also within the scope of the present invention to provide a panel having generally curved, or otherwise non-linear engaging sides 24 and 28.

A receiving unit 3 for receiving display panel 2 is shown in FIG. 3. The receiving unit 3 has an indexing element 40 for each indexing member 26 of display panel 2. The indexing element 40 is configured to accept indexing member 26. In a presently preferred embodiment, there are two indexing elements 40. Both indexing elements 40 are apertures of generally the same shape and size as indexing members 26. The receiving unit 3 also has a locking element 42 configured to accept the locking member 32 of panel 2. The locking element 42 generally comprises a lock 46 and an aperture 44 configured to interact with locking member 32. The lock 46 functions to prevent locking member 32 from disengaging with aperture 44. In the presently preferred embodiment, the lock 46 is a sliding piece which laterally encases locking member 32 in aperture 44. As an alternative, a locking element 42 could be constructed so that locking member 32 snaps into locking element 42. The locking element 42 may be any device that allows the locking member 32 to be easily disengaged from locking member 42, while maintaining engagement under normal circumstances.

Also shown in FIG. 3 are compartments 8 in the receiving unit 3, located in this embodiment above the display panels 2 for storing additional products that can be placed on display panels 2. Each compartment 8 may be accessible through a door 10 having hinge 12, although any means of closing the compartment 8 is within the contemplation of this invention. Door 10 and hinge 12 can be configured to open either vertically or horizontally. In the present embodiment, the door 10 opens vertically. Furthermore, the door 10 may be used to display advertisements or product information for consumers.

Figure 4:
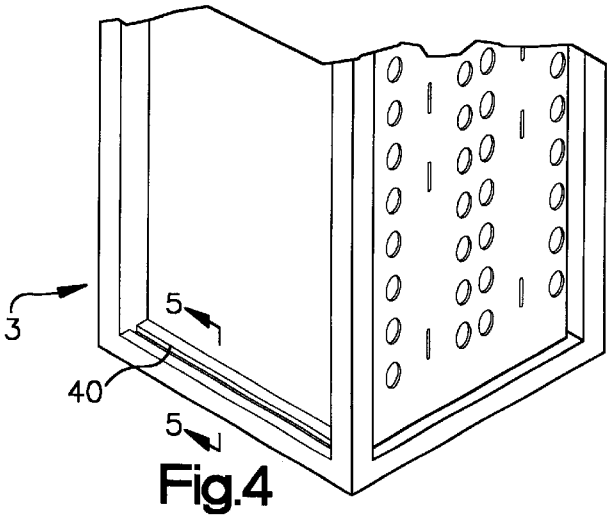
FIG. 4 is a perspective view of a portion of an alternate embodiment of a display panel and receiving unit combination.
Figure 5:
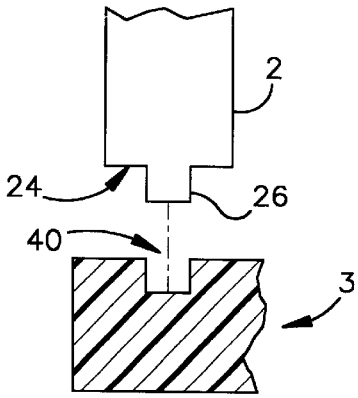
FIG. 5 is a side view of one arrangement of a display panel and a receiving unit in an alternate embodiment.

FIGS. 4 and 5 show an alternate embodiment of display panel 2 and receiving unit 3. In this embodiment, the display panel 2 is generally rectangular in shape and has a single indexing member 26 (FIG. 5) extending outward from a first engaging side 24. The indexing member 26 is a ridge running parallel along first engaging side 24. The receiving unit 3 has an indexing element 40 comprising a channel configured to accept indexing member 26.

Figure 6:
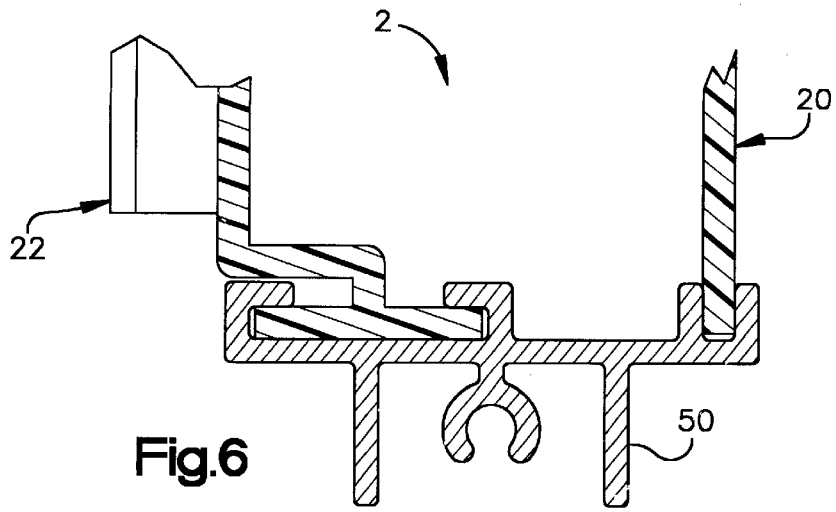
FIG. 6 is a cross-sectional view of a portion of one embodiment of a display panel.

FIG. 6 shows a particular embodiment of display panel 2, wherein the panel is not integrally molded as one piece. The panel 2 comprises a channel 50 for receiving both a first display side 20 and a second display side 22. The current panel 2 has a first display side 20 configured to display different products than second display side 22. For example, the first display side 20 may be configured to display eyeglasses, and the second display side 22 may be configured to display jewelry or other small items. While only a limited number of embodiments are shown, it should be understood that panels of any configuration may be utilized so long as they are two sided.

Figure 7:
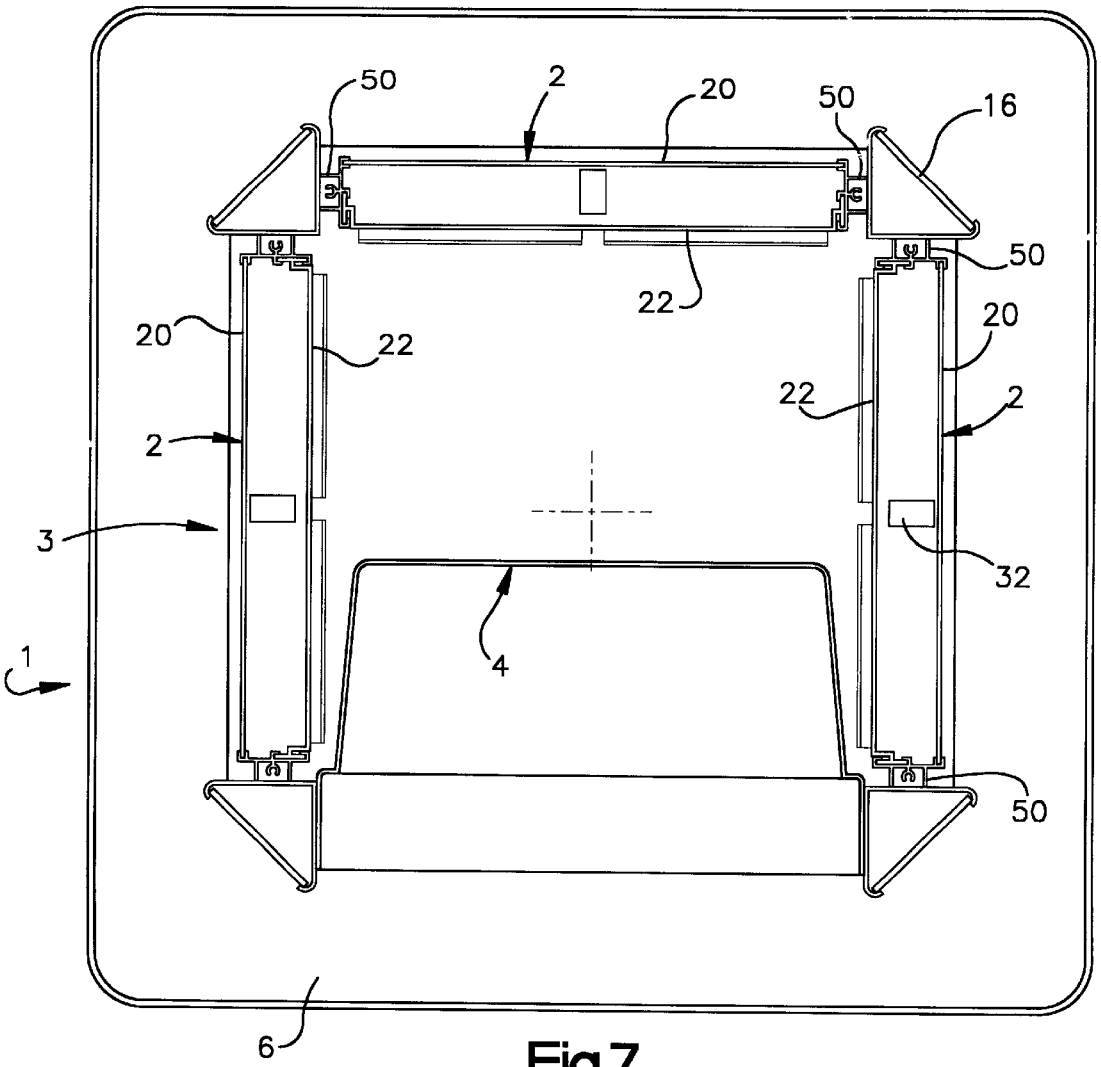
FIG. 7 is a top view of a four-sided embodiment of a convertible display unit having three display panels and one display tray.

FIG. 7 shows a particular configuration of a four-sided display unit 1 having three display panels 2 of the configuration shown in FIG. 6 and one display tray 4 (also referred to as an "accessory panel"). The display tray 4 is not designed to be reversible like panels 2. Consequently, only the display panels 2 can be changed in order to alter the configuration of the display unit 1. In the particular configuration shown in FIG. 7, the display unit 1 may be configured to display eyeglasses on one, two or three sides by configuring panels 2 so that first display side 20 faces outward. Likewise, display unit 1 can be configured to display jewelry on one, two or three sides by configuring panels 2 so that second display side 22 faces outward.

Figure 8:
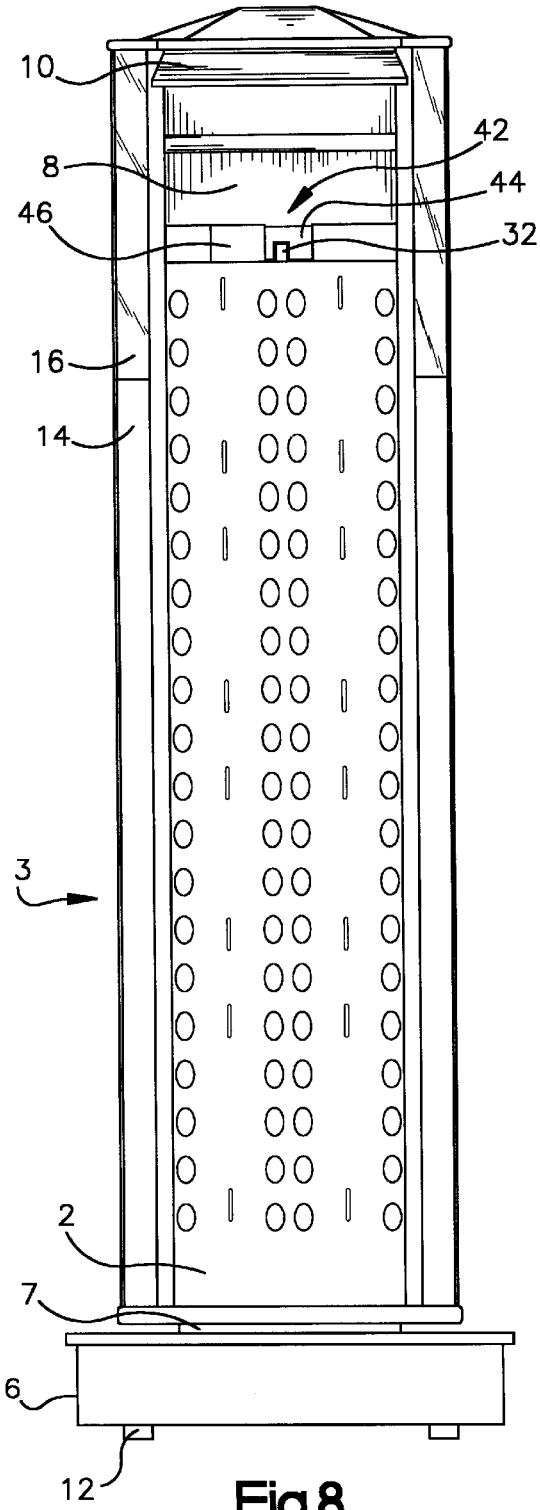
FIG. 8 is a side view of a display unit.

FIG. 8 shows a side view of one side of display unit 1. In particular, the side shown has a display panel 2 configured to display eyeglasses. The receiving unit 3 is configured to rotate with respect to base 6. Rotating means 7, which may be ball bearings or a mounting rod or the like, allows receiving unit 3 to rotate. Base 6 may also have wheels or mounts 12 to support the entire unit and facilitate movement throughout a store.

Figure 9:
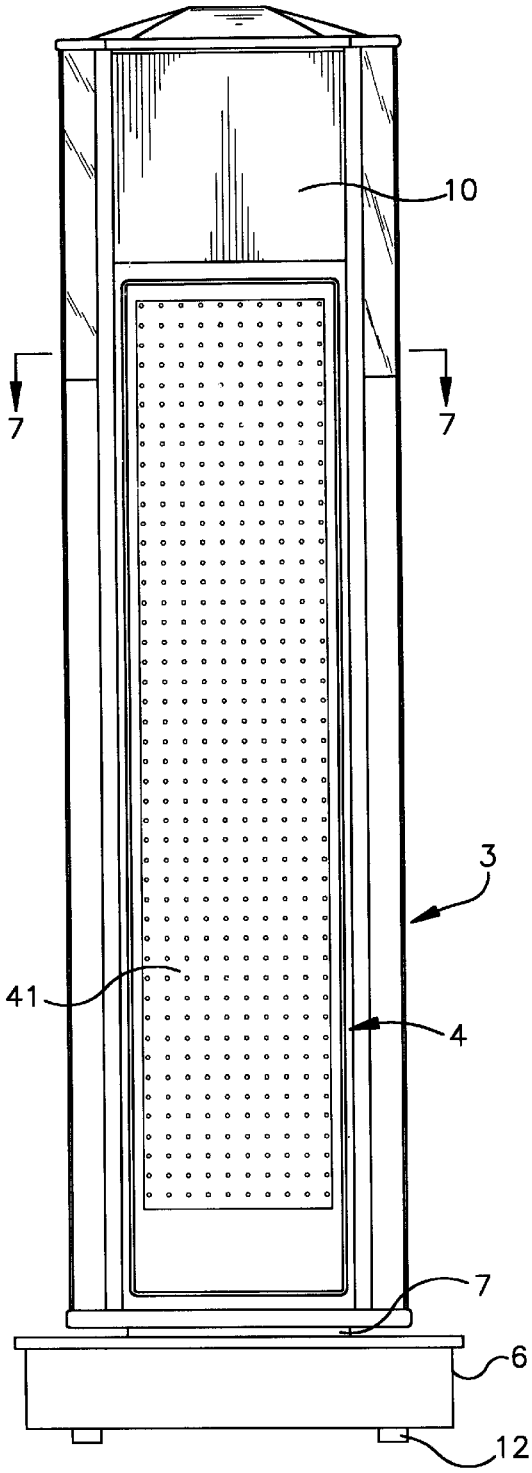
FIG. 9 is an alternate side view of a display unit.

FIG. 9 shows a side view of another side of the display unit of FIG. 6. In particular, display tray 4 is shown, wherein the major planar display surface 41 is in the form or a matrix of through-holes, in which many different types of product support devices can be engaged, such as hooks, trays or shelves. Because the display surface 41 is recessed from the corresponding plane of the exterior of the receiving unit 3, products can be stacked to the recess depth within the display tray/accessory panel, whether on hooks or shelves, to increase the display density.

Figure 10:
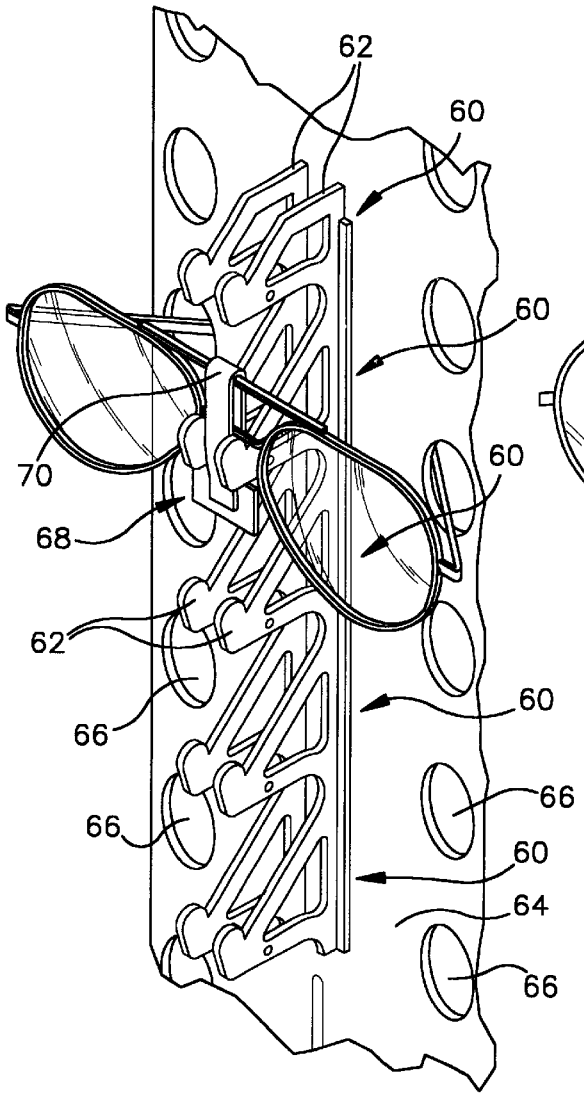
FIG. 10 is a perspective view of a series of nose bridge supports designed to accommodate eyeglasses having anti-theft tags attached to their nose bridges.
Figure 11:
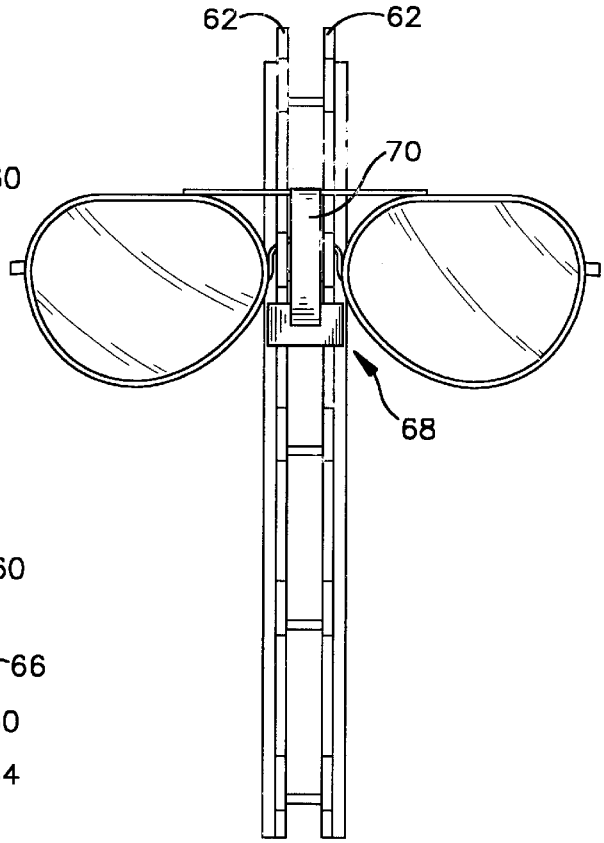
FIG. 11 is a front view of nose bridge supports and eyeglasses with an anti-theft tag.

FIGS. 10 and 11 show a series of nose bridge supports designed to accommodate eyeglasses having anti-theft tags attached to their nose bridges. In general, the nose bridge support 60 has two generally parallel support structures 62 designed to hold eyeglasses. The nose bridge support 60 may be attached to a display panel 64 that has bi-laterally located apertures or supports 66 for eyeglass arms. In addition, a series of nose bridge supports 60 may be integrally molded to match a pattern of an eyeglass display panel 64 so that each nose bridge support 60 is aligned with eyeglass arm supports 66, preferably so that the elevation of the nosebridge support is slightly higher than the corresponding eye supports 66. The support structures 62 are configured so that there exists sufficient space to accommodate a strap 70 of an anti-theft device 68 attached to a nose bridge of a pair of eyeglasses. In the present embodiment, the support structures 62 are configured to accept a generally rectangular strap 70 of an anti-theft device 68. In one form, the strap is connected to a tag 71 which contains the sensor detection device. The strap 70 is of sufficient length so that the tag 71 hangs vertically below the nose bridge support 60. In this manner, the display maintains a neat appearance even with an anti-theft device attached to each product.

The invention thus provides a flexible retail product display system which is adaptable to display and store a wide variety of products, so that the display remains fully stocked with seasonally appropriate merchandise to maximize the effectiveness of retail space. In the conversion tower aspect, the receiving unit 3 serves as a framework to support any suitable product display panel engageable with the framing structure, with the display panel having dissimilarly configured sides for supporting dissimilar types of products. This in combination with the accessory panels which have interior volume and the ability to support complimentary products of still further dissimilar type, provides a flexible high density multi-product display and storage system.

What is claimed is:

1. A convertible retail product display unit, comprising:

a) a generally planar display panel, comprising
   i) a first display side adapted to display a first product,
   ii) a second display side adapted to display a second product, the second display side generally opposed to said first display side,
   iii) an indexing member connected to a first edge of said display panel and extending outward from said display panel at a first position,
   iv) a locking member connected to a second edge of said display panel and extending outward from said display panel at a second position; and b) a receiving unit configured to accept said display panel, comprising
   i) an indexing element for receiving said indexing member of said display panel, and
   ii) a locking element for receiving said locking member of said display panel.

2. The retail product display unit of claim 1 further comprising a compartment for storing additional products.

3. The retail product display unit of claim 1 further comprising a display tray for displaying additional products.

4. The retail product display unit of claim 3 wherein said display tray has only one side configured to display products.

5. The retail product display unit of claim 1 further comprising mirrors.

6. The retail product display unit of claim 1 further comprising a base and a rotation means for the product display unit.

7. The retail product display unit of claim 1 wherein said first position is located between said first display side and said second display side.

8. The retail product display unit of claim 1 wherein said second position is located between said first display side and said second display side.

9. The retail product display unit of claim 1 wherein said display panel is generally rectangular.

10. The retail product display unit of claim 1 wherein said display panel is generally flat.

11. The retail product display unit of claim 1 wherein said display panel comprises a plurality of indexing members and said receiving unit comprises a plurality of indexing elements.

12. The retail product display unit of claim 1 wherein said indexing member extends from a first position along a longitudinal axis of said display panel and said locking member extends from a second position along a longitudinal axis of said receiving unit.

13. A convertible retail product display unit, comprising:

a) a plurality of generally planar display panels, each display panel comprising
   i) a first display side adapted to display a first product,
   ii) a second display side adapted to display a second product, the second display side generally opposed to said first display side,
   iii) an indexing member connected to a first edge of said display panel and extending outward from said display panel at a first position,
   iv) a locking member connected to a second edge of said display panel and extending outward from said display panel at a second position; and b) a receiving unit configured to accept said plurality of display panels, the receiving unit comprising
   i) an indexing element for receiving said indexing member of said display panel, and
   ii) a locking element for receiving said locking member of said display panel.

14. The retail product display unit of claim 13 wherein said display panels are generally rectangular.

15. The retail product display unit of claim 13 wherein said display panels are generally flat.

16. The retail product display unit of claim 13 further comprising a storage unit located between said display panels.

17. The retail product display unit of claim 14 wherein said storage unit is rotatable with respect to the product display unit.

18. The retail product display unit of claim 14 wherein said storage unit comprises multiple storage trays.

19. A convertible retail product display unit, comprising:

a) a generally planar display panel, comprising i) a first display side adapted to display a first product, ii) a second display side adapted to display a second product, the second display side generally, opposed to said first display side, iii) a first engaging edge generally perpendicular to said first and second display sides, the first engaging edge having an indexing member extending outward therefrom, iv) a second engaging edge generally perpendicular to said first and second display sides, the second engaging edge having a locking member extending outward therefrom; and b) a receiving unit configured to accept said display panel, comprising i) an indexing element for receiving said indexing member of said first engaging edge, and ii) a locking element for receiving said locking member of said second engaging edge.

20. The retail product display unit of claim 19 further comprising a compartment for storing additional products.

21. The retail product display unit of claim 19 further comprising a display tray for displaying additional products.

22. The retail product display unit of claim 21 wherein said display tray has only one side configured to display products.

23. The retail product display unit of claim 19 further comprising a storage unit located between said display panels.

24. The retail product display unit of claim 23 wherein said storage unit is rotatable with respect to the product display unit.

25. The retail product display unit of claim 23 wherein said storage unit comprises multiple storage trays.

26. The retail product display unit of claim 19 further comprising mirrors.

27. The retail product display unit of claim 19 further comprising a base and a means for the product display unit rotating about the base.

28. The retail product display unit of claim 19 wherein said first engaging side is located in an area between said first display side and said second display side.

29. The retail product display unit of claim 19 wherein said second engaging side is located in an area between said first display side and said second display side.

30. The retail product display unit of claim 19 wherein said display panel is generally rectangular.

31. The retail product display unit of claim 19 wherein said display panel is generally flat.

32. The retail product display unit of claim 19 wherein said display panel comprises a plurality of indexing members and said receiving unit comprises a plurality of indexing elements.

33. The retail product display unit of claim 19 wherein said indexing member is positioned along a longitudinal axis of said display panel and said locking member is positioned along a longitudinal axis of said receiving unit.

34. A convertible retail product display system, comprising a plurality of display units, each display unit having:

a) a generally planar display panel, comprising i) a first display side adapted to display a first product, ii) a second display side adapted to display a second product, the second display side generally opposed to said first display side, iii) an indexing member connected to a first edge of said display panel and extending outward from said display panel at a first position, iv) a locking member connected to a second edge of said display panel and extending outward from said display panel at a second position; and b) a receiving unit configured to accept said display panel, comprising i) an indexing element for receiving said indexing member of said display panel, and ii) a locking element for receiving said locking member of said display panel.

* * * * *